United States Patent [19]

Scheffer et al.

[11] Patent Number: 4,799,414

[45] Date of Patent: Jan. 24, 1989

[54] ROTARY CUTTER APPARATUS

[75] Inventors: Bruce A. Scheffer, Valparaiso; Eric K. Lo, Portage, both of Ind.

[73] Assignee: Scheffer, Inc., Merrillville, Ind.

[21] Appl. No.: 121,319

[22] Filed: Nov. 16, 1987

[51] Int. Cl.[4] ..... B26D 1/62

[52] U.S. Cl. ..... 83/103; 83/116; 83/346; 83/348

[58] Field of Search ..... 83/346, 348, 103, 116

[56] References Cited

U.S. PATENT DOCUMENTS

| | | | |
|---|---|---|---|
| 1,310,922 | 7/1919 | Novick . | |
| 1,746,048 | 2/1930 | Novick . | |
| 1,825,069 | 9/1931 | Kavle . | |
| 1,978,136 | 10/1934 | Kavle . | |
| 2,084,573 | 6/1937 | Cowan . | |
| 3,277,756 | 10/1966 | Des Jardins et al. . | |
| 3,499,370 | 3/1970 | Kulwicki et al. | 83/348 X |
| 3,793,918 | 2/1974 | Huffman . | |
| 3,857,314 | 12/1974 | Gregoire . | |
| 4,143,568 | 3/1979 | Cogswell | 83/348 X |
| 4,412,467 | 11/1983 | DeSanto . | |
| 4,485,710 | 12/1984 | Schlisio et al. | 83/346 |
| 4,640,165 | 2/1987 | McMahon et al. . | |
| 4,699,033 | 10/1987 | Gherardi | 83/348 |

*Primary Examiner*—Frank T. Yost

*Attorney, Agent, or Firm*—Welsh & Katz, Ltd.

[57] ABSTRACT

A variable rotary cutter assembly for transverse cutting of web material as it passes through a nip between rotating anvil and knife cylinders includes one or more cutter assemblies selectively positionable on the periphery of the knife cylinder. Each cutter assembly includes a base block adapted to be releasibly mounted on the knife cylinder, and a pair of pivotally connected block members one of which is adapted for releasibly mounting on an associated base block and the other of which carries an elongated knife blade and is outwardly pivotable about a pivot axis parallel to and spaced from the knife blade. Spring means bias the knife carrier block member outwardly about its pivot axis so as to effect a predetermined cutting pressure per unit length of the knife blade against the anvil while enabling self-adjusting movement of the knife blade to accommodate substantial variance in anvil and knife cylinder spacing and knife blade wear. The cutters assemblies may be mounted to effect single or double transverse web cuts, and stripper means are provided to strip trim strips cut from the web by pairs of knife blades.

21 Claims; 3 Drawing Sheets

ROTARY CUTTER APPARATUS

BACKGROUND OF THE INVENTION

The present invention relates generally to rotary cutters for cutting web material and the like, and more particularly to a novel self-adjusting rotary cutter apparatus which may be employed with a knife cylinder and associated anvil cylinder to effect single or double trim cuts transversely of a moving web or sheet and which facilitates reduced setup time, easier maintenance and longer knife blade life than has heretofore been attainable.

It is a conventional practice in the printing industry, and particularly in conjunction with web printing presses, to employ a rotary cutter assembly operative to transversely cut the web material received from the printing press. Such rotary cutters generally employ an anvil cylinder and a knife cylinder which are rotatable in timed relation about axes generally transverse to the direction of movement of the paper web and define a nip therebetween through which the web passes from the printing station. The knife cylinder carries one or more cutter assemblies having knife blades operative to cut or sever the web during rotation of the knife cylinder. Such rotary cutters may also be used with sheet printers to cut sheet material to predetermined length prior to passing it to a sheet type printing press.

When employed with web type printing presses, each cutter or knife assembly may carry a single knife blade to effect a single transverse cut through the moving web material, or may carry a pair of spaced knife blades operative to cut the web along parallel lines so as to create a trim or waste strip between the knife blades which is conventionally removed by means carried by the anvil or knife cylinder.

Known rotary cutter apparatus, and particularly variable rotary cutters for use in the web printing industry, exhibit a number of drawbacks which result in significant economic inefficiencies. For example, one known rotary cutter arrangement supports a pair of knife blades in an elastomeric holder having longitudinal slots which receive the knife blades. The elastomer holder is affixed to the outer periphery of a knife cylinder such that the holder yields during a cutting operation to take up radial inward movement of the cutting knives during engagement with the associated anvil cylinder. See, for example, U.S. Pat. No. 4,640,156. A drawback to such a rotary cutter arrangement is that the elastomeric material tends to take a permanent set after continued use and requires substantial maintenance to replace the blade holder or otherwise make adjustments so as to maintain the desired knife blade to anvil surface relation for efficient cutting. A further significant drawback in this type of rotary cutter arrangement is the inability to accurately adjust and maintain a desired cutting force between the cutting edges of the knife blades and the peripheral surface of the anvil cylinder.

Another known rotary web cutter apparatus supports one or more cutter blades generally longitudinally of a knife cylinder and allows for manual radial adjustment of the blades relative to the knife cylinder during rotation or roll-in of the knife cylinder so as to obtain the desired engagement of the knife blades against the anvil surface. See, for example, U.S. Pat. No. 4,466,319. Such rotary cutter apparatus require substantial setup time to precisely locate the knife blades relative to the anvil surface, and require significant downtime in the event of damage or wear to the knife blades.

As aforementioned, when employing pairs of spaced knife blades to effect parallel cuts transversely of a moving web and thereby create a waste or trim strip between the knife blades, it is desirable to provide means to remove the trim strip. One technique for removing trim strips utilizes a pin wheel operative to introduce generally radial pins between the pairs of knife blades and cause the trim strips to be released during rotation of the knife cylinder. A drawback in the use of such pin wheels lies in the low reliability of the pin wheel to completely remove a trim strip, thus leaving it between the corresponding knife blades where it is carried into the nip during the next successive web cutting cycle.

Thus, the know rotary web cutter apparatus exhibit a number of drawbacks which lead to operational and economic deficiencies due to the initital setup time required, the frequency of maintenance necessary to maintain proper operation and the relatively high skill level required for setup, maintenance and operation.

SUMMARY OF THE INVENTION

One of the primary objects of the present invention to provide a novel self-adjusting rotary cutter apparatus for use in cutting web material and the like which overcomes the drawbacks exhibited by prior rotary cutter apparatus.

A more particular object of the present invention is to provide a novel rotary cutter apparatus for use in transverse cutting of web or sheet material, and which enables precise selfadjusting control of the cutting pressure per unit length of the knife blade against the web during a cutting operation.

A further object of the present invention is to provide a rotary cutter appartus having novel means to enable precise positioning of the knife blade cutting edges relative to the knife cylinder on which the cutter apparatus is carried, and which facilitates relatively quick and precise knife blade replacement without substantial downtime of the rotary cutter apparatus.

A still further object of the present inventin is to provide a novel rotary cutter apparatus for use with a web printing machine and the like and which enables relatively rapid and precise setup by an operator having a substantially lower skill lever than has heretofore been required, thereby leading to significant economic savings.

Yet another object of the present invention is to provide a novel cutter assembly which may be employed with a rotary knife cylinder to effect single transverse web cuts, or may be employed in symmetrical opposed pairs to effect generally simultaneous double transverse web cuts in which case stripper means are provided to remove the trim or waste strips created between the pairs of knife blades.

A feature of the rotary cutter apparatus in accordance with invention lies in its ability to self-compensate so as to maintain consistent operating characteristics irrespective of changing conditions in the associated knife and anvil cylinders due, for example, to heat buildup and the like during operation.

Another feature of the rotary cutter apparatus in accordance with the invention lies in the provision of a knife blade carrier block member adapted to be pivotally mounted on a knife cylinder for pivotal movement about a pivot axis parallel to and spaced from the knife blade, and which includes means for precisely adjusting the pressure applied by the knife blade against an associated anvil cylinder as a web or sheet is passed through the nip defined between the anvil and knife cylinders, thereby enabling a precise self-adjusting cutting pressure per unit length of knife blade.

Another feature of the rotary cutter apparatus in accordance with the invention lies the provision of one or more base blocks which extend the full longitudinal length of the knife cylinder and are adapted to have one or move cutter assemblies releasably mounted thereon in a manner enabling variable positioning of the cutter assemblies about the knife cylinder without removing them from their associated base block.

Further objects, features and advantages of the invention, together with the organization and manner of operation thereof, will become apparaent from the following detailed description of the invention when taken in conjunction with the accompanying drawings wherein in like reference numerals designate like elements throughout the several views.

DETAILED DESCRIPTION

Figure 1:
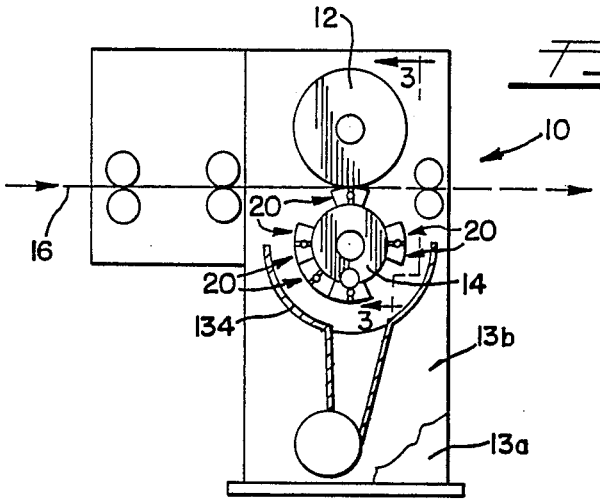
FIG. 1 is a schematic elevational view illustrating a variable rotary cutter assembly in accordance with the invention in operative association with a web to be cut generally transversely thereof, a portion of the frame structure being removed for purposes of clarity.

Referring now to the drawings, and in particular to FIG. 1, a variable rotary cutter apparatus constructed in accordance with the present invention is indicated at 10. The variable rotary cutter apparatus 10 finds particular application with a web type printing press operative to effect printing on a movable web material, such as paper, after which the web may be passed through a folder station and/or a slitter station from which the web material is passed through the rotary cutter apparatus 10 to cut the web transversely into discrete predetermined lengths.

The variable rotary cutter apparatus 10 includes a cylindrical anvil cylinder 12 which is supported between a pair of upstanding frame members 13*a* and 13*b* in overlying relation to a cylindrical knife cylinder 14. The knife cylinder 14 is also supported between the frame members 13*a,b* and cooperates with the anvil cylinder to define a nip between the anvil and knife cylinders through which a continuous web of paper material or the like, indicated at 16, passes preparatory to being cut generally transversely into discrete lengths by the rotary cutter apparatus. The knife cylinder 14 is adapted to have a plurality of cutter assemblies, each of which is indicated generally at 20, mounted on its outer peripheral surface so as to establish transverse cutter means cooperable with the anvil 12 to effect transverse cutting or severing of the web 16. To this end, drive means (not shown) are operatively associated with the anvil and knife cylinders to effect predetermined timed rotation relative to each other in opposite rotational directions and in relation to the linear speed of the web material 16 as it is fed into the nip between the anvil and knife cylinders.

The number of cutter assemblies 20 and their relative positions about the periphery of the knife cylinder 14 is dependant upon the desired mode of operation of the corresponding printer, such as 2-around, 3-around, 4-around or ⅔-around printing on the web material in a known manner. It will become apparent that the cutter assemblies 20 may also be employed to transversely cut web material into sheets prior to feeding into a sheet printer, or may be employed as an off-press cutter or inline sheeter. Further, the cutter assemblies 20 may also replace conventional male-female sawtooth cutters as employed in web press folders so as to produce finished straight cuts rather than ragged sawtooth cuts as presently delivered, thus completing the trim operation in the folder and eliminating the cost of postdelivery trimming.

A feature of the cutter assemblies 20 lies in their ability to self-adjust to variances in blade wear and anvil and knife cylinder spacing at the nip while maintaining a predetermined cutting pressure per unit length of the knife blade against the anvil cylinder. Another feature is the ability to be quickly setup for cutting the web material 16 into different longitudinal lengths depending upon the particular printing "repeat" selected for the corresponding print roll or cylinder. One or more cutter assemblies 20 may be mounted on the peripheral of the knife cylinder 14 to effect a single transvere cut of the web 16 upon each pass of a cutter assembly through the nip defined between the knife and anvil cylinders. Alternatively, the cutter assemblies 20 may be mounted on the knife cylinder in symmetrical pairs at selected positions about the peripheral of the knife cylinder to effect substantially simultaneous double transverse cuts and thereby create waste or trim strips between the respective pairs of knife blades.

Figure 2:
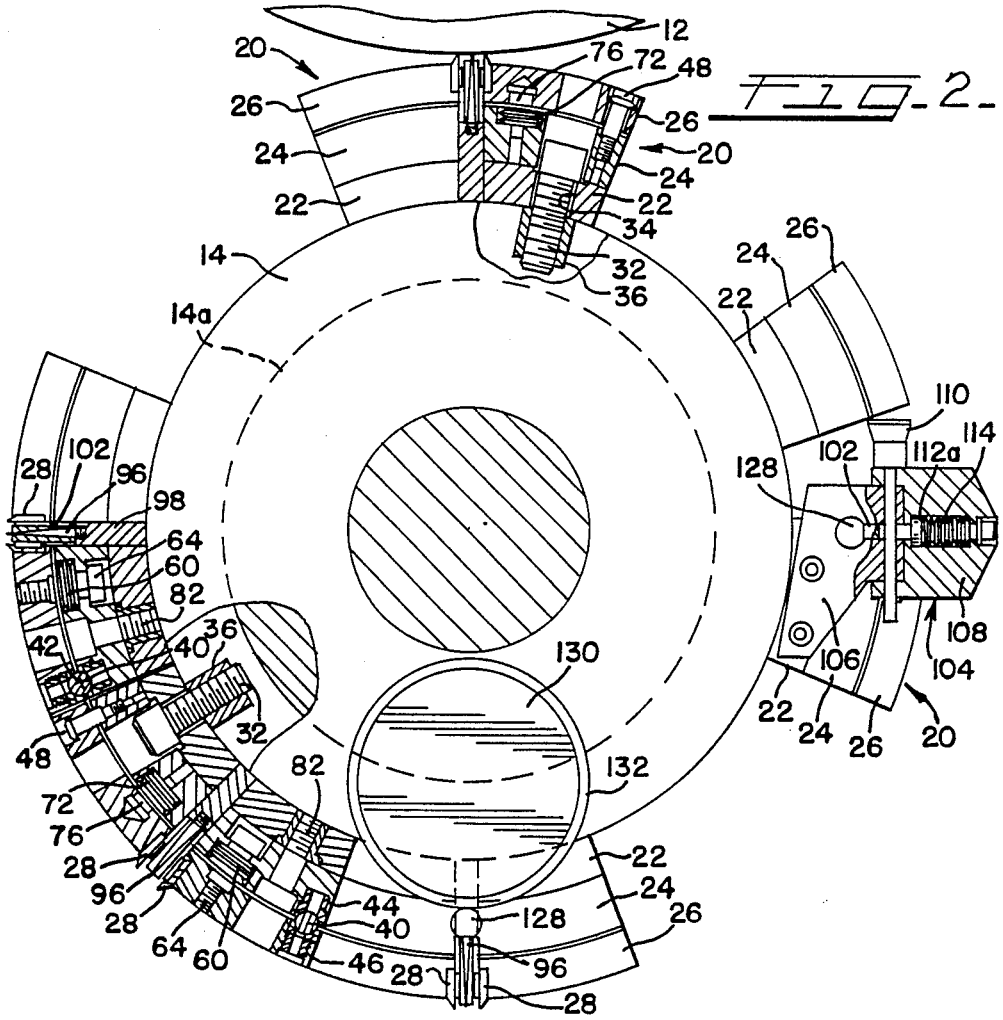
FIG. 2 is an end view of the knife cylinder of FIG. 1 having a plurality of cutter assemblies mounted thereon, portions being broken away and taken in section to illustrate various components of the cutter assemblies.
Figure 4:
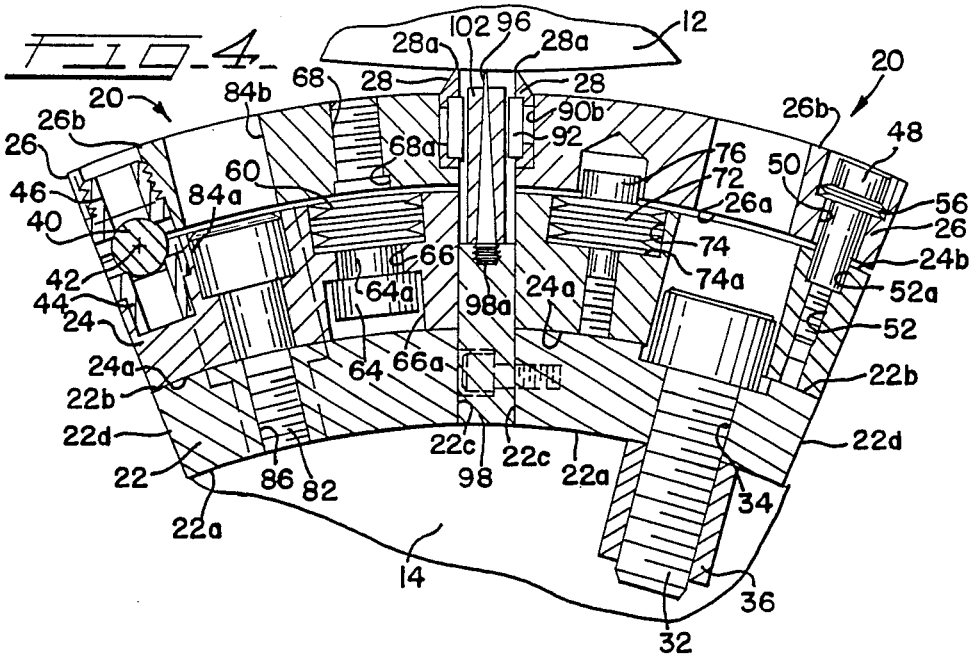
FIG. 4 is an enlarged fragmentary sectional view taken substantially along line 4—4 of FIG. 3 but illustrating the cutter assemblies at the nip position with the anvil cylinder.
Figure 3:
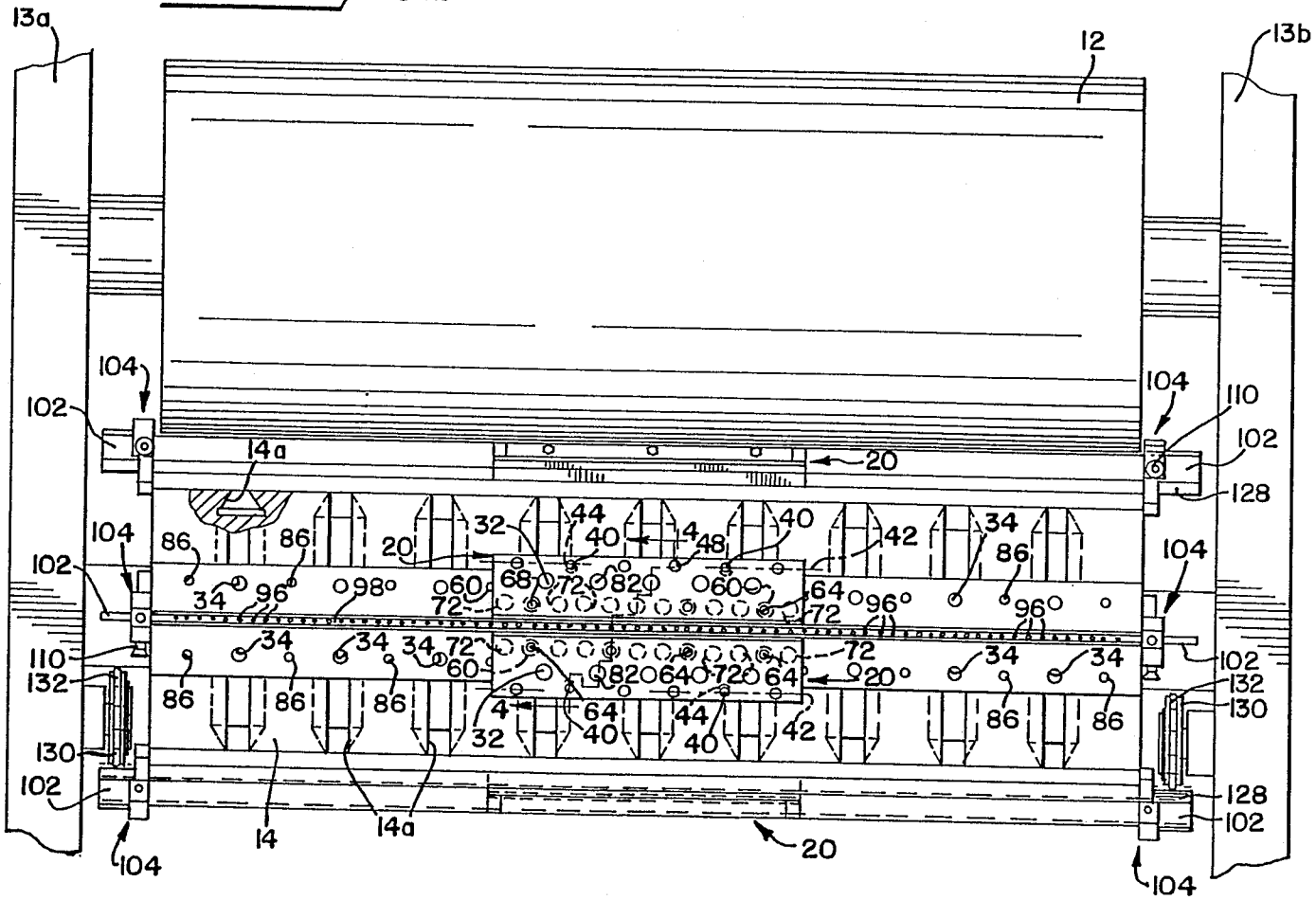
FIG. 3 is a fragmentary elevational view taken substantially along line 3—3 of FIG. 1.

Referring to FIGS. 2–4, each cutter assembly 20 in the illustrated embodiment includes a base block 22 which preferably extends the full longitudinal length of the knife cylinder 14 and is bounded by inner and outer arcuate surfaces 22*a* and 22*b* and generally radial side wall surfaces 22*c* and 22*d*. Each cutter assembly 20 further includes a block member or element 24 which is also bounded by inner and outer arcuate surfaces 24*a* and 24*b*, respectively, and has side wall surface generally coplanar with the side surfaces 22*c,d* of the corresponding base block. Each block member 24 is adapted to be releasably mounted on the associated base block 22 and pivotally supports an outer block member or element 26 which, in turn, carries an elongated knife blade 28 having a rectilinear cutting edge 28*a*. As will be described, the knife blade 28 of each cutter assembly 20 is adapted to engage the anvil cylinder and be displaced inwardly toward the axis of the knife cylinder as it passes through the nip during each revolution of the knife cylinder. Each knife blade is passed outwardly against the anvil cylinder so as to effect a predetermined cutting pressure against the web per unit length of the knife blade.

Turning now to a more detailed description of the cutter assemblies 20, the base block 22 of each cutter assembly is adapted to be selectively positioned about the outer cylindrical surface of the knife cylinder through a plurality of capscrews 32 which extend through suitable radial bores 34 in the base block and have conventional dovetail nuts 36 threaded onto their radially inner ends. The nuts 36 are adapted to be inserted into annular dovetail groves **14*b* formed in longitudinally spaced relation along the length of the knife cylinder, and enable releasable locking of the base blocks 22 about the peripheral of the knife cylinder. The block members 24 and 26 will generally be made of shorter length that their associated base block 22 so as to have a longitudinal length slightly greater than the length of cut necessary to sever the full transverse width of the web 16 which may comprise, for example, one or more web strips of approximately 6-inch or 12-inch width. Thus, one or more cutter assemblies 20 may be selectively affixed along the length of each base block 22** depending upon the transverse cutting pattern desired.

As aforementioned, the block member 26 of each cutter assembly 20 is supported on its associated block member 24 through means enabling pivotal movement of each block member 26 relative to its associated block member 24. To this end, a plurality of spherical balls 40 are interposed between the block members 24 and 26 so as to define a pivot axis, represented by lines 42 in FIG. 3, which pass through the centers of the balls 40 in parallel relation to the rotational axis of the knife cylinder and parallel to the associated knife blade 28 carried by the block member 26. In the illustrated embodiment, two balls 40 are mounted between each pair of block members 24 and 26 spaced equally from the opposite ends thereof. Each ball 40 is seated between a pair of tubular headened bearing seats 44 and 46 mounted in axially aligned relation in the block members 24 and 26. In the illustrated embodiment, the spherical balls 40 and associated bearing seats 44 and 46 are sized to establish approximately 0.030 inch spacing between the block members 24 and 26 at the pivot axis 42.

Each block member 26 is retained in hinged or pivotal relation to its associated block member 24 through a plurality of capscrews 48 received within bores 50 in block member 26 and having threaded engagement with tapped bores 52 formed in block member 24 such that the axes of the capscrews lie in a common plane containing the rotational axis of the knife cylinder 14 and the corresponding pivot axis 42. The bores 50 in block 26 which receive the shanks of capscrews 48 are slightly larger in diameter than the capscrew shanks to enable pivotal movement of the block member 26 about the corresponding pivot axis 42 relative to its underlying block member 24.

As illustrated in FIG. 4, the shank of each capscrew 48 is bottomed within a counterbore **52*a* coaxial with the associated threaded bore 52. A plurality of belleville type springs 56 are captured between the head end of each capscrew 48 and an annular shoulder surface formed at the base of a corresponding counter bore 58. The length of the shank portion of each capscrew 48 and the spring rate of the springs 56 are selected to bias the bearing seats 44 and 46 against the associated balls 40** in sliding relation therewith.

The outer block member 26 of each cutter assembly 20 is biased pivotally outwardly relative to its associated pivot axis 42 by spring means in the form of a series of belleville type springs 60 captured between annular shoulder surfaces at the bases of counterbores 62 formed in the block member 24 and the adjacent inner surface **26*a* of the outer block member. Shoulder bolts 64 extend through bores 66 in the block member 24 coaxial with counterbores 62 and have threaded connection to tapped bores 68 in the corresponding block member 24. The shank portion 64*a* of each shoulder bolt 64 passes through the corresponding annular belleville springs 60 and bottoms against an annular shoulder formed at the base of a corresponding counterbore 68*a* in the block member 24. The longitudinal length of each shank portion 64*a* is selected so that the head of the corresponding shoulder bolt engages an annular shoulder surface at the base of a counterbore 66*a* to limit outward pivotal movement of the block member 24 relative to the block member 26 and establish a uniform spacing between the block members 24 and 26 of approximately 0.030 inch. In this manner, the outer block member 24 is maintained in predetermined parallel spaced relation to the associated block member 26 during rotation of the knife cylinder except when the corresponding knife blade 28 is at the nip position engaging the anvil cylinder 12 during a cutting operation. Each block member 26 is further biased pivotally outwardly relative to its associated block member 24 by a plurality of belleville springs 72 which are substantially identical to the belleville springs 60 and are captured between an annular shoulder 74*a* of a counterbore 74 within block member 24 and the adjacent inner surface 26*a* of the outer block member. A pilot shaft 76 is captured within a blind bore 78 in the block member 26 coaxial with the counterbore 74 such that the pilot shaft extends through the annular springs 72. By inserting the shoulder bolts 64 from the inner surface 26*a* of a block member 26, the initial preload or outward bias of block member 26 relative to its associated block member 26 may be precisely established by the belleville springs 60 and 72 and cannot be altered or tampered with by an operator after the pivotally connected block member 24 and 26 are mounted on an associated base block 22. Alternative types of springs, such as coil compression springs, may be employed rather than the belleville springs 60 and 72** if desired.

As illustrated in FIG. 3, the longitudinal axes of the shoulder screws 64 and associated springs 60 lie in a common plane containing the axes of corresponding springs 72 and the axis of rotation of the knife cylinder, such common plane being parallel to the blade knife 28.

Each pivotally connected pair of block members 24 and 26 may be releasably mounted on an underlying base block through capscrews 82 inserted within aligned bores **84*a* and 84*b* in the block members 24 and 26, respectively, such that the capscrews threadedly engage tapped bores 86 in the base block 22 in alternating equidistantly spaced relation to the bores 34. In this manner, an operator may readily and quickly release a pivotally connected pair of block members 24 and 26 from an underlying base block 22** for interchanging with a different length cutter knife blade or to select a different knife cutting pressure.

Figure 5:
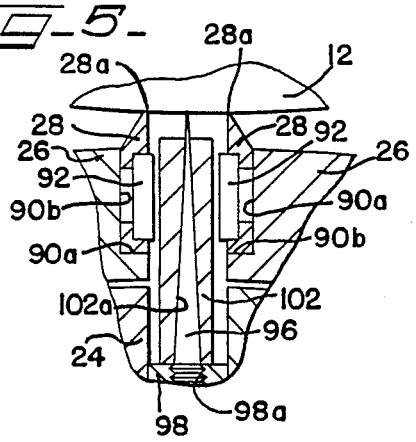
FIG. 5 is a fragmentary vertical sectional view illustrating a pair of opposed knife blades and an intermediate trim stripper pin and stripper bar.

A feature of the cutter assemblies 20 lies in the ability to remove a knife blade 28 from a cutter assembly relatively quickly, and precisely reinstall the knife blade after sharpening or replace the knife blade with another knife blade. Referring to FIG. 5, each block member 26 has a generally rectangular longitudinal recess defined by right angle surfaces 90*a* and 90*b*. The recess surfaces 90*a* and 90*b* serve as reference surfaces to receive and accurately position a rectangular knife blade 28 such that the outer cutting edge 28*a* of the knife blade is precisely positioned relative to the associated block member 26. The knife blades 28 are releasably affixed within the blade recesses 90*a,b* by capscrews 92 which extend through suitable bores spaced longitudinally along the knife blades and have threaded engagement with the corresponding block member 26. In the illustrated embodiment, each knife blade 28 is positioned to establish a maximum interference with the outer cylindrical surface of the anvil cylinder of approximately 0.025 inch.

A further feature of the rotary cutter apparatus 10 lies in the provision of means for removing trim strips created between pairs of knife blades 28 when employing one or more pairs of symmetrically mounted cutter assemblies 20 on the knife cylinder as illustrated in FIGS. 3 and 4. In the illustrated embodiment, a plurality of generally conical stripper pins 96 are supported in aligned spaces relation along a stripper pin support bar 98 which is affixed to a trailing radial side surface 22*c* of the base block 22 of the lead cutter assembly 20 of each pair of cutter assemblies. The stripper pin support bar 98 extends the full longitudinal length of the associated base block 22 and has a plurality of spaced tapped bores 98*a* to threadedly mount the stripper pins 96 such that the longitudinal axes of the stripper pins extend in radial relation to the rotational axis of the knife cylinder and are generally equally spaced along the support bar. The outer tips of the stripper pins 96 are preferable formed with 4-pronged fork ends positioned so that the tips never extend radially outwardly beyond a plane defined by the cutting edges 28*a* of the corresponding knife blades during a cutting operation. In this manner, when the knife blades 28 are depressed during web cutting engagement with the anvil cylinder, the trim strip cut from the web is impaled by the underlying stripper pins and carried away from the nip area.

Figure 6:
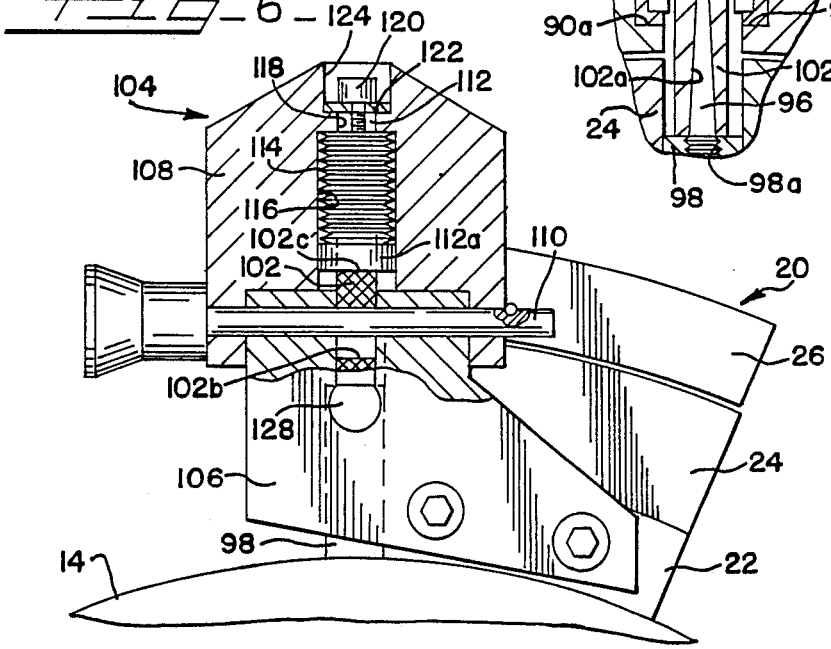
FIG. 6 is an enlarged fragmentary view taken from the end of the knife cylinder and illustrating a trim stripper bar biasing means.

The trim stripper means includes means to eject cut trim strips impaled and carried by the stripper pins when the stripper pins reach approximately the 6-o'clock position during rotation of the knife cylinder. To the end, a stripper bar 102 is supported on the radial outer surface of each stripper pin support bar 98 and has generally conical or cylindrical bores 102*a* located to receive the stripper pins 96 therethrough. Referring to FIGS. 3 and 6, each stripper bar 102 extends outwardly beyond the opposite ends of the knife cylinder 14 and is resiliently biased against the outer surface of the associated pin support bar 98 by biasing means, indicated generally at 104, mounted on the opposite ends of the corresponding base block 22 outboard of the ends of the knife cylinder as illustrated in FIG. 3.

Each stripper bar biasing means 104 includes a support bracket 106 which is suitably affixed to the outer end surface of the corresponding base block 22 and supports a spring housing 108 through a releasable retainer pin 110 which extends through an elongated opening 102*b* in the outer extension of the corresponding stripper bar. The opposite outwardly extending ends of the stripper bar 102 each have a recessed surface 102*c* against which the enlarged head 112*a* of a pilot shaft 112 is biased by spring means in the form of a plurality of annular belleville springs 114 received over the pilot shaft and captured between the head 112*a* and an annular shoulder formed at the base of a bore 116 within the spring housing 108. The pilot shaft 112 is longitudinally slidable through a bore 118 formed in the spring housing coaxial with the bore 116. A capscrew 120 is affixed to the upper end of the pilot shaft 112 and secures an annular washer 122 against the end of the pilot shaft. The washer 122 and capscrew head are received within a counterbore 124 in the spring housing 108. In this manner, radial inward movement of the head 112*a* of a pilot shaft 112 against the corresponding recessed stripper bar surface 102*c* under the influence of the springs 114 is limited by the washer 122.

The radial inner edge of each outwardly extending end of the stripper bar 102 preferably has a rounded lobe 128 affixed thereon for engagement with a circular cam wheel or hub 130 which is rotatably supported by an associated one of the frame members 13*a* or 13*b* such that the axes of rotation of the cam wheels lie substantially in a plane containing the rotational axes of the anvil and knife cylinders 12 and 14, that is, at the 6-o'clock position of rotation of the knife cylinder as illustrated in FIG. 2. Each of the cam wheels 130 preferably carries an elastomeric O-ring 132 about its peripheral surface positioned to be engaged by the lobe 128 on the corresponding end of the stripper bar 102 as it passes through the 6-o'clock position during each revolution of the knife cylinder. The cam wheels 130 and associated O-rings are positioned to effect a predetermined radial outward movement of each stripper bar 102 as it passes through the 6-o'clock position so as to strip the previously cut trim strip from the corresponding stripper pins 96. The stripped trim strips or chips may then be drawn into a waste receptacle or chamber through a vacuum hood 134 as illustrated schematically in FIG. 1.

Having thus described a preferred embodiment of the variable cutter assembly 10 in accordance with the invention, it will be apparent that the cutter assemblies 20 may be affixed to the periphery of the knife cylinder 14 so as to effect single transverse cuts of the moving web 16 or, alternatively, may be mounted in symmetrical pairs to effect substantially simultaneous cutting of parallel transverse cuts of the web as each pair of cutter blades 28 passes through the nip between the knife and anvil cylinders. As previously described, the cutting edges 28*a* of the knife blades 28 are positioned to engage the web against the anvil cylinder and be depressed radially a predetermined distance, such as 0.025 inch, with resultant severing of the web. By supporting the knife blades 28 for pivotal movement about their corresponding pivot axes 42 against the force of the biasing springs 60 and 72, all interference with the anvil cylinder is accommodated by self-adjusting pivotal movement of the knife blade with the result that damage to the knife blades upon impacting the anvil cylinder is substantially eliminated thereby leading to significantly longer knife blade life. Such self-adjustment of the knife blades accommodates variances in blade wear and anvil and knife cylinder spacing at the nip while maintaining the desired predetermined cutting pressure per unit length of the knife blades against the anvil cylinder.

By predetermined selection of the springs 60 and 72, a very precise cutting force may be effected between the knife blades and the anvil cylinder. It has been found that selecting the springs 60 and 72 to effect a cutting force between the knife blades and anvil cylinder of approximately 600 pounds per linear inch along the knife blades will generally result in a desired cut through the web 16. It will be understood that the cutting force obtained between the knife blades and anvil cylinder may be varied as desired dependant upon the type of web material being cut. As aforementioned, alternative types of springs, such as coil compression springs, may be employed in place of the belleville springs 60 and 72, as well as springs 56 and 114.

As aforedescribed, the number and angular positions of the cutter assemblies 20 about the knife cylinder may be selected to obtain a desired number of transverse cuts through the web 16 for each revolution of the knife cylinder. The positions of the various cutter assemblies 20 about the periphery of the knife cylinder may be readily varied through loosening of the capscrews 32 without removing the associated block members 24 and 26 from the associated base block 22. Where single transverse cuts through the web material 16 are desired, as opposed to dual cuts with resulting trim strips, one or more sets of pivotally connected block members 24 and 26 may be mounted directly on the knife cylinder without employing a base block 22. Such single blade mounting may be effected by capscrews, such as 82, having dovetail nuts on their radial inner ends which are received within selected dovetail grooves 14*a* periphery of the knife cylinder.

Thus, in accordance with the invention, selective positioning of one or more cutter assemblies about the periphery of a knife cylinder, as well as initial attachment and replacement of the knife blades 28, may be readily undertaken by operators with substantially less skill than required by prior rotary web cutter apparatus. The lower skill level of the operator is further brought about by the ability of the cutter assemblies 20 to be preloaded prior to assembly onto an associated base block 22 and by preventing access to the springs 60 and 72 and associated shoulder bolts 64 while the pivotally connected pairs of block members 24 and 26 are mounted on a corresponding base block 22. Precise preloading or selection of the outward biasing forces acting on the block members 26, and the pivotal mounting of the knife blades allows the knife blades to effectively undergo self-adjustment as the machine characteristics vary throughout operation, such as upon heating of the various components. Still further, problems of harmonic vibration created by impacting of the knife blades against the anvil cylinder are substantially eliminated by the cutter assemblies 20, thus allowing substantially higher cutting speeds to be sustained.

While a preferred embodiment of the invention has been illustrated and described, it will be understood that changes and modifications may be made therein without departing from the invention in its broader aspects. Various features of the invention are defined in the following claims.

What is claimed is:

1. A cutter assembly for use in a rotary web cutter apparatus or the like having rotatable anvil and knife cylinders defining a nip therebetween through which web material passes during generally transverse cutting thereof, said cutter assembly comprising a first block member adapted to be mounted on the periphery of a knife cylinder for rotation through the nip between the knife cylinder and an anvil cylinder, a second block member supporting an elongated knife blade thereon and being mounted on said first block member for pivotal movement about a pivot axis parallel to and spaced from said knife blade, and means cooperative with said first and second block members to bias said second block member about said pivot axis away from said first block member but enabling pivotal movement of said second block member toward said first block member when said cutter assembly is mounted on a knife cylinder and said knife blade engages an associated anvil cylinder during a web cutting operation.

2. A cutter assembly as defined in claim 1 wherein said biasing means comprises spring means interposed between said first and second block members and operative to bias said second block member generally radially outwardly about said pivot axis when the cutter assembly is mounted on a knife cylinder.

3. A cutter assembly as defined in claim 2 wherein said spring means is captured between said first and second block members and is adapted to apply a predetermined cutting force by said knife blade against an anvil cylinder when mounted on a knife cylinder and passed through a nip between the anvil and knife cylinders.

4. A cutter assembly as defined in claim 3 wherein said spring means comprises a plurality of belleville type springs.

5. A cutter assembly as defined in claim 2 wherein said spring means is captured between said first and second block members in a manner to prevent access to said spring means when said cutter assembly is mounted on the periphery of a knife cylinder.

6. A cutter assembly as defined in claim 1 further including means cooperative with said first and second block members to limit the extent of outward pivotal movement of said second block member relative to said first block member.

7. A cutter assembly as defined in claim 6 wherein said spring means comprises annular spring means interposed between said first and second block members, said pivotal movement limiting means including a limiting bolt coaxial with said annular spring means and cooperative with said first and second block members to limit the extent of outward pivotal movement of said second block relative to said first block member.

8. A cutter assembly as defined in claim 1 wherein said pivot axis is defined by a plurality of spherical balls interposed between said first and second block members and positioned to define said pivot axis spaced from and parallel to said knife blade.

9. A cutter assembly as defined in claim 8 including retaining means cooperative with said first and second block members to resiliently urge said first and second block members into saeated engagement with said spherical balls.

10. A cutter assembly as defined in claim 1 wherein said second block member defines a knife receiving reference surface thereon, said knife blade being adapted to engage said reference surface, and including means releasably attaching said knife blade to said second block member.

11. A cutter assembly as defined in claim 1 including a base block adapted for direct mounting on the peripheral surface of a knife cylinder, said base block being adapted to have one or more of said cutter assemblies mounted thereon along its longitudinal length.

12. A variable rotary cutter assembly for use in cutting a web material or the like comprising, in combination, a generally cylindrical anvil cylinder, a generally cylindrical knife cylinder, frame means supporting said anvil and knife cylinders such that their longitudinal axes lies in a common plane and define a nip therebetween through which the web material may pass during rotation of said anvil and knife cylinders, and at least one cutter assembly mounted on the peripheral surface of said knife cylinder and including a first block member adapted to be mounted on said knife cylinder, a second block member mounted on said first block member for pivotal movement about a pivot axis parallel to the rotational axis of said knife cylinder, an elongated knife blade carried by said second block member in parallel spaced relation to said pivot axis and defining a cutting edge thereon, and means operatively associated with said first and second block members in a manner to bias said second block member pivotally outwardly from said first block member such that said cutting edge engages said anvil cylinder at said nip to effect a generally transverse cut through web material passing through said nip upon rotation of said knife cylinder.

13. A rotary cutter assembly as defined in claim 12 wherein said biasing means comprises spring means interposed between said first and second block members and biasing said second block member generally radially outwardly relative to said first block member.

14. A rotary cutter assembly as defined in claim 13 including means operatively associated with said first and second block members so as to limit the extent of outward pivotal movement of said second block member relative to said first block member.

15. A rotary cutter assembly as defined in claim 12 wherein said pivot axis is defined by a plurality of spherical balls interposed between said first and second block members.

16. A rotary cutter assembly as defined in claim 15 including means resiliently urging said first and second block members against said spherical balls while enabling relative pivotal movement therebetween about said pivot axis.

17. A rotary cutter assembly as defined in claim 16 wherein said biasing means comprises spring means interposed between said first and second block members in a manner to apply a predetermined cutting force between said knife blade and said anvil during a web cutting operation.

18. A variable rotary cutter assembly as defined in claim 12 including at least one pair of said cutter assemblies mounted in symmetrical opposed relation on the periphery of said knife cylinder so as to define a pair of parallel knife blades operative to sever a web along parallel cut lines as said knife blades pass through said nip position upon rotation of said knife cylinder whereby to create a trim strip between said knife blades, and including stripper means operative to impale said trim strip and remove it from said nip position during rotation of said knife cylinder.

19. A rotary cutter assembly as defined in claim 18 wherein said stripper means includes a plurality of stripper pins interposed between said knife blades and operative to impale said trim strip, and stripper bar means cooperative with said stripper pins in a manner to eject said trim strip from said stripper pins at a predetermined rotational position of said knife cylinder.

20. A rotary cutter assembly as defined in claim 19 wherein said stripper bar extends outwardly beyond at least one end of said knife cylinder, and including cam actuator means operative to effect radially outward movement of said stripper bar relative to said stripper pins so as to eject a trim strip carried on said stripper pins.

21. A rotary cutter assembly as defined in claim 20 wherein said stripper means includes means biasing said stripper bar to a first radially inward position relative to said stripper pins, said cam actuator means being operative to move said stripper bar radially outwardly relative to said stripper pins to eject a trim strip therefrom during rotation of said knife cylinder.

* * * * *

UNITED STATES PATENT AND TRADEMARK OFFICE

CERTIFICATE OF CORRECTION

PATENT NO. : 4,799,414

DATED : January 24, 1989

INVENTOR(S) : Bruce A. Scheffer and Eric K. Lo

It is certified that error appears in the above-identified patent and that said Letters Patent is hereby corrected as shown below:

Column 1, line 48, "4,640,156" should be --4,640,165--.

Column 2, line 17, "know" should be --known--.

Column 2, line 33, "selfadjusting" should be --self-adjusting--.

Column 2, line 43, "inventin" should be --invention--.

Column 2, line 47, "lever" should be --level--.

Column 3, line 11, "move" should be --more--.

Column 3, line 17, "apparaent" should be --apparent--.

Column 4, line 21, "inline" should be --in-line--.

Column 4, line 26, "postdelivery" should be --post-delivery--.

Column 4, line 38, "transvere" should be --transverse--.

Column 4, line 66, "passed" should be --biased--.

Column 5, line 16, "that" should be --than--.

Column 7, line 24, "spaces" should be --spaced--.

Column 10, line 50, "saeated" should be --seated--.

Signed and Sealed this

Fourteenth Day of November, 1989

*Attest:*

JEFFREY M. SAMUELS

*Attesting Officer* *Acting Commissioner of Patents and Trademarks*